US007080604B2

(12) United States Patent
Sakuma et al.

(10) Patent No.: US 7,080,604 B2
(45) Date of Patent: Jul. 25, 2006

(54) LOWER THREAD SUPPLYING APPARATUS FOR SEWING MACHINE

(75) Inventors: Kuniharu Sakuma, Chofu (JP); Hiroshi Kotaki, deceased, late of Chofu (JP); by Yumiko Kotaki, legal representative, Tokyo (JP); Atsushi Shiraishi, Chofu (JP)

(73) Assignee: Juki Corporation, Tokyo (JP)

( * ) Notice: Subject to any disclaimer, the term of this patent is extended or adjusted under 35 U.S.C. 154(b) by 0 days.

(21) Appl. No.: 11/042,020

(22) Filed: Jan. 24, 2005

(65) Prior Publication Data

US 2005/0211145 A1 Sep. 29, 2005

(30) Foreign Application Priority Data

Jan. 23, 2004 (JP) ..... P.2004-015979

(51) Int. Cl.
*D05B 65/00* (2006.01)

(52) U.S. Cl. ..... 112/298

(58) Field of Classification Search ..... 112/186, 112/228–229, 231–232, 296, 298
See application file for complete search history.

(56) References Cited

U.S. PATENT DOCUMENTS 3,490,402 A * 1/1970 Ketterer ..... 112/184
4,095,539 A * 6/1978 Johnson ..... 112/184
4,292,906 A * 10/1981 Johnson ..... 112/184
4,646,665 A * 3/1987 Jimenez et al. ..... 112/260
4,748,925 A * 6/1988 Takei et al. ..... 112/260
5,025,737 A * 6/1991 Kamiya ..... 112/296
5,131,340 A * 7/1992 Tajima et al. ..... 112/292

FOREIGN PATENT DOCUMENTS

JP 2985256 10/1999

* cited by examiner

*Primary Examiner*—Danny Worrell
(74) *Attorney, Agent, or Firm*—Merchant & Gould P.C.

(57) ABSTRACT

A lower thread supplying apparatus for a sewing machine has a bobbin accommodating portion 11 for detachably accommodating a lower thread bobbin 12 from an opening part 101*c*, a tension applying portion 13 for hitching a lower thread, a lower thread cutting knife 14 provided at the end portion of a lower thread passing route with a predetermined length, a cover 15 for covering the opening part 101*c*, a cover plate 20 for covering around the lower thread bobbin 12, a bending portion 16, a first guide portion 30 for introducing the lower thread to the bending portion and a second guide portion 40 for introducing the lower thread to the lower thread cutting knife. The bobbin accommodating portion, the tension applying portion, the bending portion and the lower thread cutting knife are provided at an inner area of the opening part 101*c*.

18 Claims, 9 Drawing Sheets

LOWER THREAD SUPPLYING APPARATUS FOR SEWING MACHINE

The present invention claims foreign priority to Japanese patent application no. P.2004-015979, filed on Jan. 23, 2004, the contents of which is incorporated herein by reference.

BACKGROUND OF THE INVENTION

1. Field of the Invention

The present invention relates to a lower thread supplying apparatus for a sewing machine.

2. Description of the Related Art

Generally, a sewing machine includes a horizontally rotating hook for hitching an upper thread and an under thread so as to sew. The upper thread is inserted in a sewing needle vertically moving at an end of an arm part of the sewing machine. The under thread is extracted from a bobbin of a lower thread supplying apparatus under a needle plate which is positioned on the top surface of the sewing machine under the arm part.

At the beginning of a sewing operation, it is necessary to extract some extent of the lower thread from the bobbin for hitching with the upper thread. Then, the some extent of the extracted lower thread is required for securing in a space which is not affected by any external influence to prevent the generation of extra tension until the extracted thread is used up in the process of the sewing operation in order to properly form a seam.

With the above-mentioned conditions, in a conventional sewing machine, the lower thread supplying apparatus has an inner hook detachably accommodating the bobbin from an opening part arranged at the needle plate; a tension applying portion arranged in an internal hook to apply tension by hitching the lower thread extracted from the bobbin; a lower thread cutting knife positioned with a gap having predetermined length which is defined from the tension applying portion as required for the sewing operation; a lower thread holding space secured from the tension applying portion to the lower thread cutting knife to protect the lower thread from external influence; and a guide groove part to introduce the lower thread extracted from the bobbin into the lower thread holding space and to introduce the end portion of the thread to the lower thread cutting knife (for example, refer to Japanese Patent Examined Publication no. JP-B-2985256).

In the needle plate, a needle hole is formed for inserting a sewing needle, and the above-mentioned opening part is formed upstream in a cloth feeding direction and around the needle hole. Also, in the opening part, the lower thread cutting knife is attached at the same height with a top surface of the needle plate at a sewing operation so as not to hinder sewing cloths.

In addition, the lower thread cutting knife is arranged at a position downstream than the opening part in the cloth feeding direction and away from the needle hole in a direction perpendicular to the cloth feeding direction.

Further, the lower thread holding space and the guide groove are formed between the edge portion of the opening part and the lower thread cutting knife on the needle plate to follow along a line connecting between the bobbin and the lower thread cutting knife. In other words, the guide groove is formed on the top surface of the needle plate and the inner space of the groove is connected to the lower thread holding space.

After the lower thread is extracted from the bobbin to an upstream side of the cloth feeding direction and then hitched to the tension applying portion. After that, it is bent to a downstream of the cloth feeding direction and then inserted into the inner space from the starting end of the guide groove part at the edge of the opening part. Additionally, if the lower thread is pulled to a lower thread cutting knife side, the lower thread is moved along an edge of the top surface of the needle plate of the curved guide groove part, and the end of the lower thread is inserted into the lower thread supporting space and further introduced to the lower thread cutting knife and then the lower thread is cut.

At this time, the lower thread with its edge portion cut is secured with a length needed for further sewing operation as the lower thread cutting knife is positioned at a predetermined length away from the tension applying portion. Since a cover is mounted on the opening part, the lower thread between the tension applying portion and the starting edge of the guide groove part is placed under the cover foe protection from any external interference. Also, the lower thread between the starting edge of the guide groove part and the lower thread cutting knife is placed in the lower thread holding space for protection from any external influence.

Therefore, if the sewing operation is started, the lower thread is extracted smoothly without extra tension greater than that is imposed by the tension applying portion to properly form a seam from the beginning of the sewing operation.

As described above, the lower thread cutting knife is arranged at a position away with a predetermined distance from the tension applying portion to secure lower thread having a predetermined length. Thus, the guide groove part and the lower thread holding space are formed on the needle plate, at a lower thread passing route from the edge portion of the opening part to the lower thread cutting knife.

However, there has been a problem in that the reduction in strength of the needle plate occurs because the increase in the thin parts of the needle plate results from the presence of the guide groove part and lower thread holding space.

Further, it is preferable that the top surface of the needle plate is flat and smooth in view of the fact that cloth is placed and moved on the needle plate. However, there has been another problem in that the smooth movement of cloth is interfered to cause damage as the presence of the guide groove part imparts in unevenness on the top surface of the needle plate.

SUMMARY OF THE INVENTION

In view of the foregoing, it is an object of the present invention to improve the strength of the needle plate.

It is another object of the present invention to protect cloth and to improve the quality of sewing operation.

According to a first aspect of the present invention, there is provided a lower thread supplying apparatus for a sewing machine, the lower thread supplying apparatus provided at an inner portion of a bed portion of the sewing machine, comprising:

a bobbin accommodating portion for detachably accommodating a lower thread bobbin from an opening part provided at a needle plate;

a tension applying portion for hitching a lower thread extracted from the lower thread bobbin so as to apply tension to the lower thread;

a lower thread cutting knife provided at an end portion of a lower thread passing route with a predetermined length to cut the lower thread;

a cover for covering the opening part being capable of opening and closing;

a cover plate provided lower than the cover and higher than the tension applying portion for covering around the lower thread bobbin;

a bending portion provided at a part of an edge portion of the cover plate for bending the lower thread from a lower side of the cover plate to an upper side of the cover plate;

a first guide portion for introducing the lower thread from the tension applying portion to the bending portion; and a second guide portion for introducing the lower thread from the bending portion to the lower thread cutting knife, wherein the bobbin accommodating portion, the tension applying portion, the bending portion and the lower thread cutting knife are provided at an inner area of the opening part.

The opening and closing of the cover means the possibility of attachment and detachment in addition to convertible states of opening and closing of the cover, opening of the cover when it is detached and closing of the cover when it is attached.

In the above-mentioned structure, the lower thread bobbin is accommodated at the bobbin accommodating portion with the cover of the opening part opened. In addition, if the lower thread is taken out from the lower thread bobbin and extracted higher than the cover plate while being hitched to the tension applying portion and if the end of the lower thread is pulled toward the bending portion, the lower thread is guided to the bending portion by the first guide portion. At this time, the cover plate is positioned higher than the tension applying portion, so that the lower thread is placed under the cover plate between the tension applying portion and the bending portion.

Furthermore, as the lower thread is bent from the bending portion and then placed, the lower thread is extracted to the top of the cover plate from its bottom and bend the pulling direction so as to draw the extracted end portion of the lower thread to the lower thread cutting knife.

As a result, the lower thread is guided by the second guide portion to the lower thread cutting knife, so that the extracted end portion of the lower thread is cut.

In the above-mentioned structure, the lower thread is hitched and positioned at the bobbin accommodating portion, the tension applying portion, the first guide portion, the bending portion and the second guide portion and the lower thread cutting knife, thereby forming a lower thread passing route. The lower thread passing route is set with a predetermined distance from the bobbin accommodating portion needed for the start of the sewing operation, and a predetermined length of the lower thread is kept extracted from the bobbin when cut by the lower thread cutting knife.

Moreover, all the parts of making the lower thread passing route are arranged at the inner area of the opening part, so that the lower thread is completely accommodated in the lower area of the cover to prevent any exposure. Therefore, the lower thread will not be squeezed in the cover or cloth, and any excessive tension is not generated at the beginning of the sewing operation.

In addition, since the bending portion is positioned on the lower thread passing route, the lower thread is bent and accommodated at the inner area of the opening part even if the length of the lower thread secured in advance for the sewing operation is greater than the width of the opening part.

A lower thread supplying apparatus according to a second aspect of the present invention according to the first aspect of the present invention, it is preferable that the part of the edge portion of the cover plate is formed as the first guide portion for guiding the lower thread to the bending portion in sliding contact.

Accordingly, the lower thread is introduced to the bending portion by making the lower thread sliding contact with the edge portion which corresponds to the first guide portion and moving the lower thread along with the edge portion.

Meanwhile, the "edge portion" means an end around the cover plate or edge surfaces which commonly have the edge portion of the cover plate, and including an end zone formed by hole, a groove, a step or cuttings, which will be applied identically to description to the rest part of the present invention.

According to a third aspect of the present invention according to the first aspect of the present invention, it is preferable that the first guide portion includes a slant part at the edge portion of the cover plate for sliding the lower thread under the cover plate.

In the above-mentioned structure, when the first guide portion guides the lower thread to the bending portion, the slant part guides the lower thread from the edge portion of the cover plate consisting of the guide portion to its bottom such that the lower thread is held under the cover plate between the tension applying portion and the bending portion.

According to a fourth aspect of the present invention according to any one of the first to third aspects of the present invention, it is more suitable that the other part of the edge portion of the cover plate is formed as the second guide portion for introducing the lower thread to the lower thread cutting knife in sliding contact.

Therefore, the lower thread is introduced to the lower thread cutting knife while kept in contact with the other edge portion of the cover plate which corresponds the second guide portion.

According to a fifth aspect of the present invention according to the fourth aspect, it is more preferable that the second guide portion includes a slant part at the edge portion of the cover plate for sliding the lower thread under the cover plate.

In the above-mentioned structure, when the second guide portion guides the lower thread to the lower thread cutting knife, the slant part guides the lower thread from the edge portion of the cover plate consisting of the second guide portion to its bottom such that the lower thread is held under the cover plate between the tension applying portion and the bending portion.

According to sixth to eighth aspects of the present invention according to the first to fifth aspects of the p resent invention, it is suitable that a thread pressing portion is provided between the bending portion and the lower thread cutting knife for passing the lower thread thereunder.

In the above-mentioned structure, the lower thread is guided to the lower thread cutting knife after getting passed under the thread pressing portion from the bending portion. As a result, if the lower thread is cut by the lower thread knife, the lower thread is pressed from the top to thereby prevent the lower thread from freely springing out upwardly due to the tension of the lower thread and from springing the cut portion of the lower thread out of the opening part.

According to the first aspect of the present invention, it is possible to prevent generation of excessive tension to the lower thread caused by an accidental squeeze of the lower thread under the cover or cloth as the bobbin accommodating portion, the tension applying portion, the first guide portion, the bending portion, the second guide portion and the lower thread cutting knife are all arranged at the inner area of the opening part. As a result, a seam is properly formed from the beginning of the sewing operation, thereby improving quality of the sewing operation.

Furthermore, the cover plate is positioned higher than the tension applying portion to make the lower thread pass under the cover plate between the tension applying portion and the bending portion, thereby reducing any external influence on the lower thread.

Also, according to the present invention, the bending portion is included in the lower thread passing route, so that a predetermined length of the lower thread needed for the sewing operation is secured to thereby make it possible to accommodate the lower thread passing route at the inner portion of the opening part which is not made big. As a result, it is not necessary to form an area, a groove or a concaved portion on the top surface of the needle plate, for accommodation of the lower thread as in the conventional example, thereby making it possible to minimize the opening part and maintain the strength of the needle plate high.

Besides, the groove or the concave portion interfering the movement of a cloth can be eliminated to improve quality of the sewing operation as well as to protect the cloth without causing any damage.

As the first guide portion is formed for introducing the lower thread from the tension applying portion to the bending portion, the lower thread is easily moved to the bending portion to thereby improve work efficiency.

Moreover, the second guide portion is formed for introducing the lower thread from the bending portion to the lower thread cutting knife, the lower thread is moved and positioned at the lower thread cutting knife to thereby improve work efficiency.

According to the second aspect of the present invention, the edge portion of a part of the cover plate is formed as the first guide portion for guiding the lower thread to the bending portion while being kept in contact with the lower thread, thereby improving productivity due to a reduction in the number of parts and further increasing positive economic effects.

Besides, as the lower thread is moved along the first guide portion, the edge portion of the cover plate for inducement to the bending portion, the lower thread can be hitched to the bending portion with ease and rapidly to thereby improve the work efficiency.

According to the third aspect of the present invention, since the slant part is formed for guiding the lower thread under the cover plate at the first guide portion which corresponds to the edge portion of the cover plate, the lower thread between the tension applying portion and the bending portion is covered and is held under the cover plate. Accordingly, it is efficiently restricted any external interference onto the lower thread, effectively prevented generation of excessive tension to the lower thread at the beginning of the sewing operation and improved quality of the sewing operation.

In addition, the slant part makes the lower thread positioned in a protection area with ease and rapidly, thereby further improve work efficiency.

According to the fourth aspect of the present invention, a part of the edge portion of the cover plate is formed as the second guide portion for guiding the lower thread to the lower thread cutting knife while being kept in sliding contact with the lower thread, thereby improving productivity due to a reduction in the number of parts and further increasing positive economic effects.

Besides, as the lower thread is moved along the second guide portion, the edge portion of the cover plate and finally introduced to the lower thread cutting part, the lower thread can be hitched to the bending portion with ease and rapidly, thereby improving work efficiency.

According to the fifth aspect of the present invention, the slant part is formed for guiding the lower thread under the cover plate in the second guide portion which corresponds to the edge portion of the cover plate and supporting the lower thread under the cover plate between the bending portion and the lower thread cutting knife, thereby efficiently restricting any external interference onto the lower thread, effectively preventing generation of excessive tension to the lower thread at the beginning of the sewing operation and improving quality of the sewing operation. In addition, the slant part makes the lower thread positioned in the supporting parts with ease and rapidly, thereby further improving work efficiency.

According to the sixth to eighth aspects of the present invention, the thread pressing portion is included between the bending portion and the lower thread cutting knife for pressing the lower thread thereunder from the top and passing it smoothly, thereby preventing the end portion of the lower thread from freely springing out of the opening part because of tension when the lower thread is cut by the lower thread cutting knife. As a result, the thread pressing portion makes it possible to prohibit generation of extra tension due to the squeeze of the lower thread in the cloth or any other external influence, thereby properly forming a seam and further improving quality of the sewing operation.

DETAILED DESCRIPTION OF THE PREFERRED EMBODIMENTS (General Structure of an Embodiment)

Figure 1:
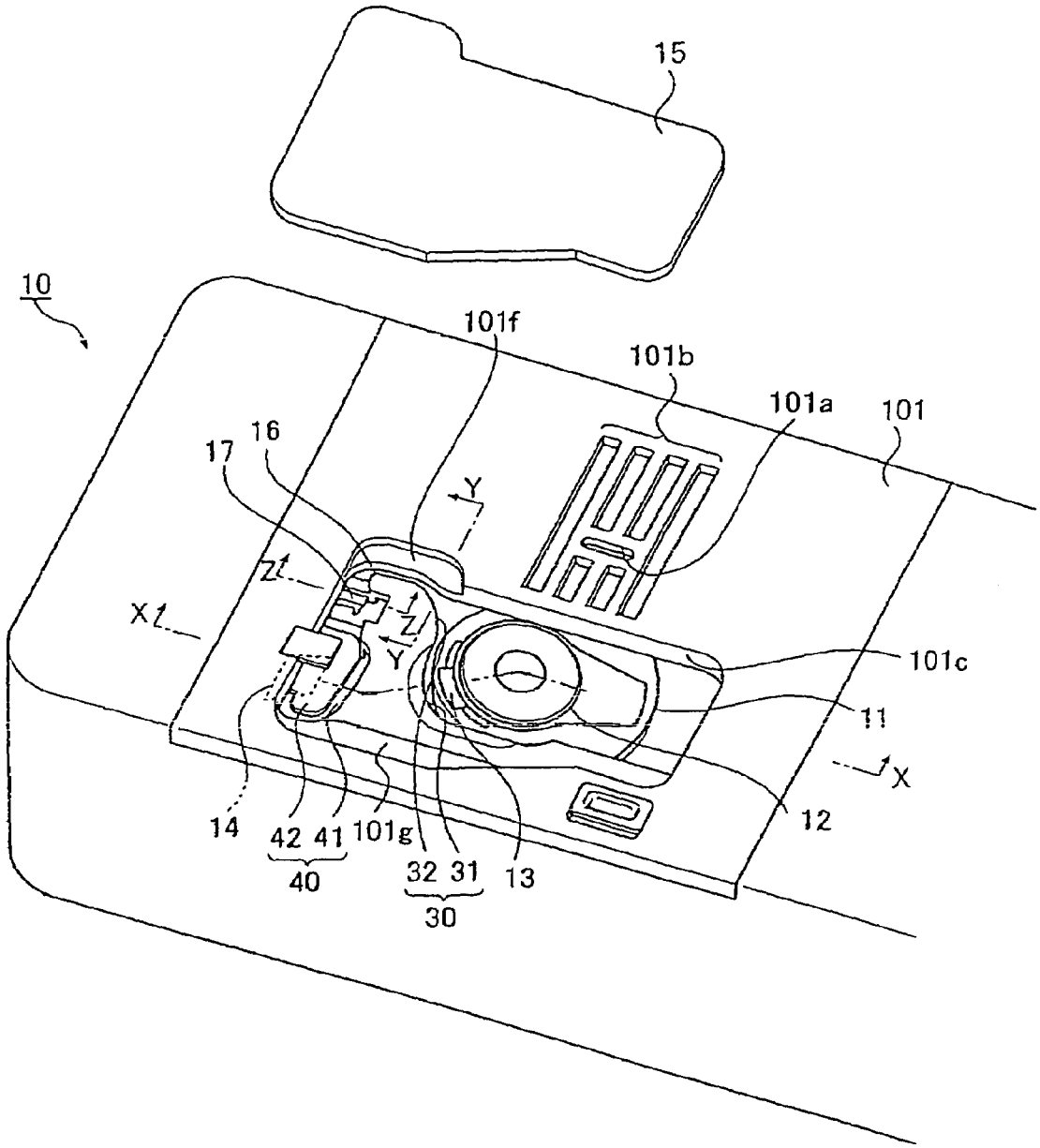
FIG. 1 is a perspective view illustrating a lower thread supplying apparatus of a sewing machine.
Figure 2:
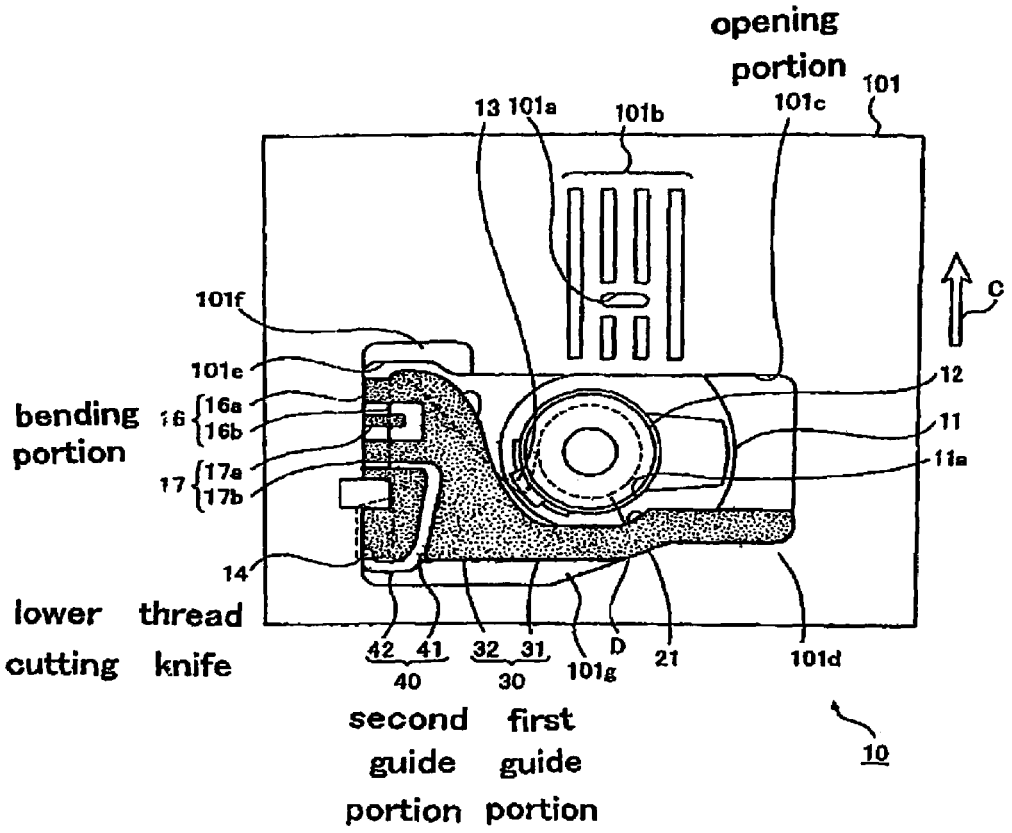
FIG. 2 is a plan view of the lower thread supplying apparatus of the sewing machine.

An embodiment of the present invention is illustrated in accordance with FIGS. 1 through 11. The figures show a lower thread supplying apparatus 10 mounted on a sewing machine of the embodiment. FIG. 1 is a perspective view for illustrating the lower thread supplying apparatus 10 of a sewing machine, and FIG. 2 is a plan view for illustrating the lower thread supplying apparatus 10. Besides, an arrow C shown in FIG. 2 indicates a cloth feeding direction. As indicated by the arrow C, the top and bottom portions of FIG. 2 indicate respectively upstream and downstream of the cloth feeding direction.

The sewing machine relating to the present embodiment includes a bed part 102 and an arm part (not shown) positioned over the bed part and extended in the direction almost identically to the bed part 102 for holding a vertically moving sewing needle (not shown) at its end. On the bed part 102, a needle plate 101 on which cloth to be sewed is placed at the time of sewing operation is provided.

Besides, the needle plate 101 includes a needle hole 101*a* just under the sewing needle, and holes 101*b* formed around the needle hole 101*a*. Feed dogs (not shown) for feeding cloth appears and disappear through the holes 101*b*. An opening part 101*c* is formed at the upstream of the cloth feeding direction. A lower thread bobbin 12 which supplies the lower thread to the apparatus 10 is taken in or out through the opening part 101*c*. The opening part is formed substantially in a rectangular shape with its shorter side set identically to the cloth feeding direction.

Moreover, the lower thread supplying apparatus 10 is mainly positioned at the inner zone of the bed part 102, around and under the opening part 101*c* of the needle plate 101.

A horizontally rotating hook device is mounted in the bed part 102. The horizontally rotating hook device includes an external hook rotated by a vertically shaped rotational shaft and an internal hook held inside the external hook. A loop seizing beak part is provided at the outer circumference of the external hook for capturing a loop of an upper thread from the sewing needle. The lower thread bobbin 12 on which the lower thread D is wound is held in the internal hook 11 functioning as a bobbin accommodating portion of the lower thread supplying apparatus 10.

The external hook rotates and thus hitches the upper thread and the lower thread D by passing the internal hook through loops of the upper thread captured by the loop seizing beak part.

The lower thread supplying apparatus 10 of the sewing machine constructed as such includes: an internal hook 11 functioning as a bobbin accommodating portion for accommodating the lower thread bobbin which is detachable from the opening part 101*c* arranged at the needle plate 101; a tension applying portion 13 for applying tension by getting hitched to the lower thread D extracted from the lower thread bobbin 12; a lower thread cutting knife 14 arranged at the end of the lower thread passing route for securing a predetermined length of the lower thread D extracted from the lower thread bobbin 12; a cover 15 for opening or closing the opening part 101*c*; a cover plate 20 for covering around the lower thread bobbin 12 under the cover 15; a bending portion 16 for hitching and bending the lower thread D; a first guide portion 30 for introducing the lower thread D to the bending portion 16 when the lower thread D is arranged from the tension applying portion 13 to the bending portion 16; a second guide portion 40 for introducing the lower thread D to the lower thread cutting knife 14 when the lower thread D is moved from the bending portion 16 to the lower thread cutting knife 14; and a thread pressing portion 17 arranged between the bending portion 16 and the lower thread cutting knife 14 for preventing the lower thread from freely springing outside at the time of cutting the lower thread.

(Lower Thread Bobbin and Internal Hook)

Figure 3:
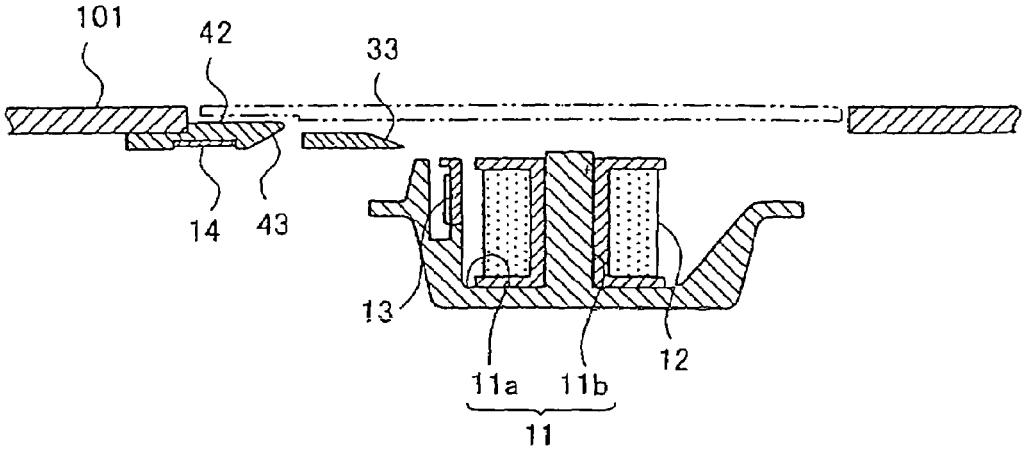
FIG. 3 is a cross-sectional view illustrating the side cut along line X—X in FIG. 1.

FIG. 3 is a cross-sectional view for illustrating a side cut along line X—X in FIG. 1. The lower thread bobbin 12 includes a shaft onto which the lower thread D is wound and a flange part formed at the both ends of the shaft.

The internal hook 11 includes a concave part 11*a* formed at the center of the internal hook 11 in a downward concave for accommodating the lower thread bobbin 12 and a spindle 11*b* vertically installed at the center of the bottom surface of the concave part 11*a* for being inserted into the shaft of the lower thread bobbin 12. The lower thread bobbin 12 can be easily moved into or out of the concave part 11*a* of the internal hook 11 by vertical movement along the spindle 11*b*.

In addition, the internal hook 11 is made in a size to be able to pass through the opening part 101*c* of the needle plate 101. However, the peripheral area of the concave part 11*a* is pressed from the top by the cover plate 20 for preventing the internal hook 11 from moving upward or dropout.

(Tension Applying Portion)

The tension applying portion 13 includes a plate member and a spring (not shown) for pushing the plate member to a rotational direction in reverse to a lower thread winding direction (to the near side in FIG. 1). The plate member is curved in an arc shape, positioned at a top end of an inner wall of a concave part 11*a* of the internal hook 11, and supported to be able to move along The circumference of the lower thread bobbin 12. Also, the plate member of the tension applying portion 13 can apply tension on the lower thread D by applying elasticity if the lower thread D is hitched and positioned at the end of the downstream of the elasticity applying direction.

(Cover Plate)

In FIG. 2, the cover plate 20 is colored gray for easily distinguishing from other parts. The cover plate 20 is a type of a resin plate member which is separate from the needle plate 101 and is integrated with the bending portion 16, the thread pressing portion 17, the first guide portion 30 and the second guide portion 40. The bending portion 16, the first and second guide portions 30, 40 are also colored gray.

The cover plate 20 is arranged between the needle plate 101 and the internal hook 11, and functions as preventing upward movement or diversion of the internal hook 11. The cover plate 20 is shaped to substantially cover an area which is defined as a lower portion of a diagonal joining an angular part 101*d* at the right side of FIG. 2 in the upstream side of the cloth feeding direction C and an angular part 101*e* at the left side of FIG. 2 in the downstream side of the cloth feeding direction C.

The shape of the cover plate 20 is described in more detail. The edge of the cover plate 20, which is ranging from the area close to the angular part 101*d* of the above-mentioned opening part 101*c* to the area close to the other angular part 101*e*, is formed in a continuous curve. A portion of the edge includes a hook pressing part 21 for pressing the internal hook from the top, and the other portion of the edge includes the above-mentioned first guide portion 30.

The hook pressing part 21 covers a portion of the top surface with insertion of the concave part 11*a* of the internal hook 11, thereby restricting the upward movement of the internal hook 11.

(The First Guide Portion)

The first guide portion 30 includes a first curve part 31 and a second curve part 32. The first curve part is an edge portion of an arc shape which is along with the outer peripheral of the outer lower thread bobbin 12 of the inner hook 11 and passes through outside of the tension applying portion 13, shown in FIG. 2. The second curve part 32 is an edge portion which is connected to the edge 31 and curved so as to from the bobbin 12 for reaching to the bending portion 16. The lower side of the plate member of the cover plate 20 forming The first arid second curve parts 31, 32 is designated as the lower thread holding area for passing the lower thread D.

As shown in FIG. 3, a sloped slant side 33 dropping down toward the lower thread bobbin 12 is formed at the top surface of the first curve part 31 (refer to FIG. 3). When preparing the lower thread D, it should be moved to a position lower than the top surface of the tension applying portion 13 to hitch the lower thread D extracted from the bobbin 12. It is preferable that the top surface of the first cover part 13 close to the tension applying portion 13 is lowered down in view of the work efficiency.

Figure 4:
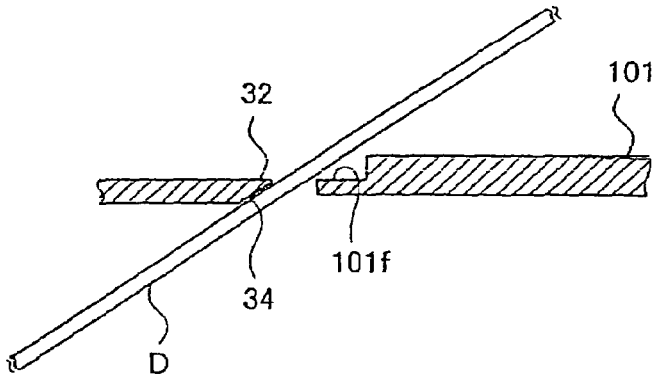
FIG. 4 is a cross-sectional view illustrating the side cut along line Y—Y in FIG. 1.

FIG. 4 is a crass-sectional view for illustrating the side cut long line Y—Y in FIG. 1. As shown in FIG. 4, a slant side 34 as a sloped slant part rising up to the end is fanned at the lower surface of the second curve part 32. At this time, the second curve part 32 ii protruded from a line defined between the tension applying portion 13 and the bending portion, and a top surface of the second curve part 32 is set to be higher than the tension applying portion 13.

Due to the such described structure, when the lower thread D is hitched from the tension applying portion 13 to the bending portion 16, an extracted end of the lower thread D can be moved left side as shown in FIG. 2 from the state that the extracted end of the lower thread D is drawn from the tension applying portion 13 to the downstream of the cloth feeding direction C. Accordingly, it possible to introducing the lower thread D to the lower thread holding area under the cover plate 20 while being in sliding contact along the edge of the second curve part 32.

In other words, a simple manipulation is made at the end of the lower thread to hitch the lower thread D from the tension applying portion 13 to the bending portion 16 with ease and smoothness.

Meanwhile, a step part 101*f* is formed at the edge of the opening part 101*c* of the needle plate 101 which is close to the edge of the second curve part 32. The step part 101*f* is lower than the other top surface of the needle plate 101. The top surface of the step part 101*f* is set up level with that of the second curve part 32. When the lower thread D is hitched from the tension applying portion 13 to the bending portion 16, it is easier and smoother to perform the process of hitching the lower thread by the step part 101*f* with its slant shape.

(Bending Portion)

Figure 5:
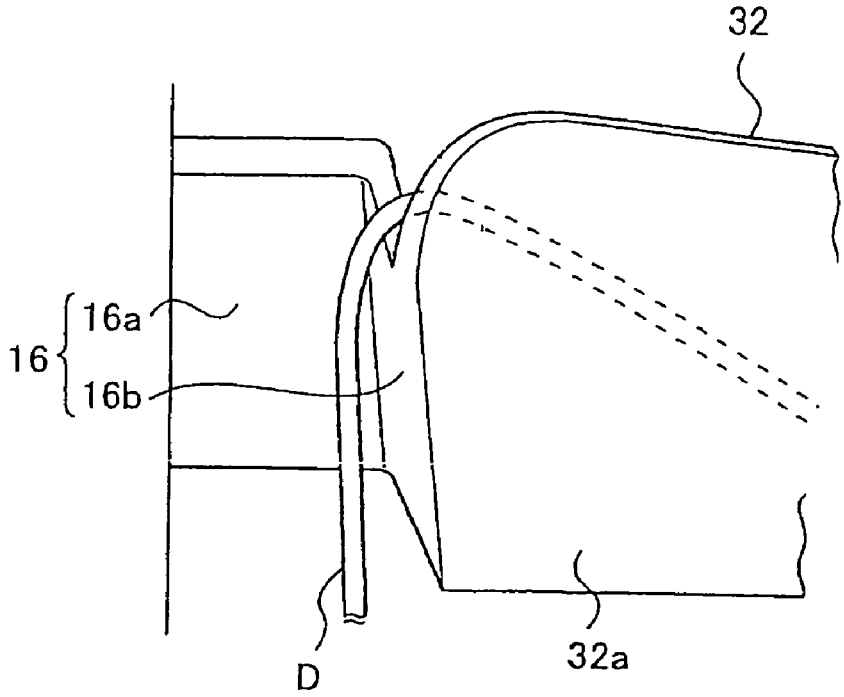
FIG. 5 is a perspective view of a bending portion.

FIG. 5 is a perspective view for illustrating the bending portion 16. As shown in FIGS. 1, 2 and 5, the bending portion 16 includes a plate surface part 16*a* which is lower than a plate surface part 32*a* formed in the above-mentioned second curve part 32 and a lateral wall part 16*b* which is integrally connected with the plate surface parts 16*a* and the plate surface part 32*a* at a position close to the angular part 101*e* of the cover plate 20.

Therefore, the lower thread D guided to the lower surface side of the plate surface part 32*a* by the first guide portion 30 is bent by the lateral wall part 16*b* and re-bent to the upstream side of the cloth feeding direction C by changing the direction of the extracted end of the lower thread to the upstream side of the cloth feeding direction C from the state that the extracted end of the lower thread D is drawn from the tension applying portion 13 to the bending portion 16.

(Thread Pressing Portion)

Figure 6:
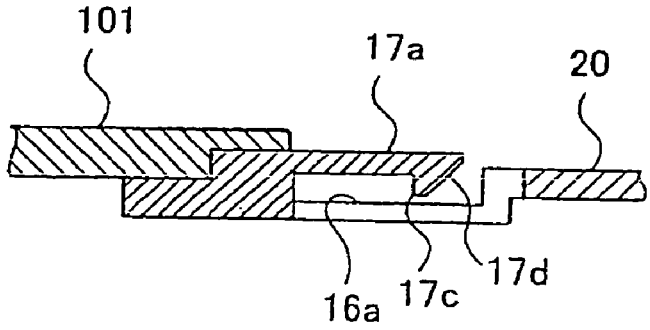
FIG. 6 is a cross-sectional view illustrating the side cut along line Z—Z in FIG. 1.
Figure 7:
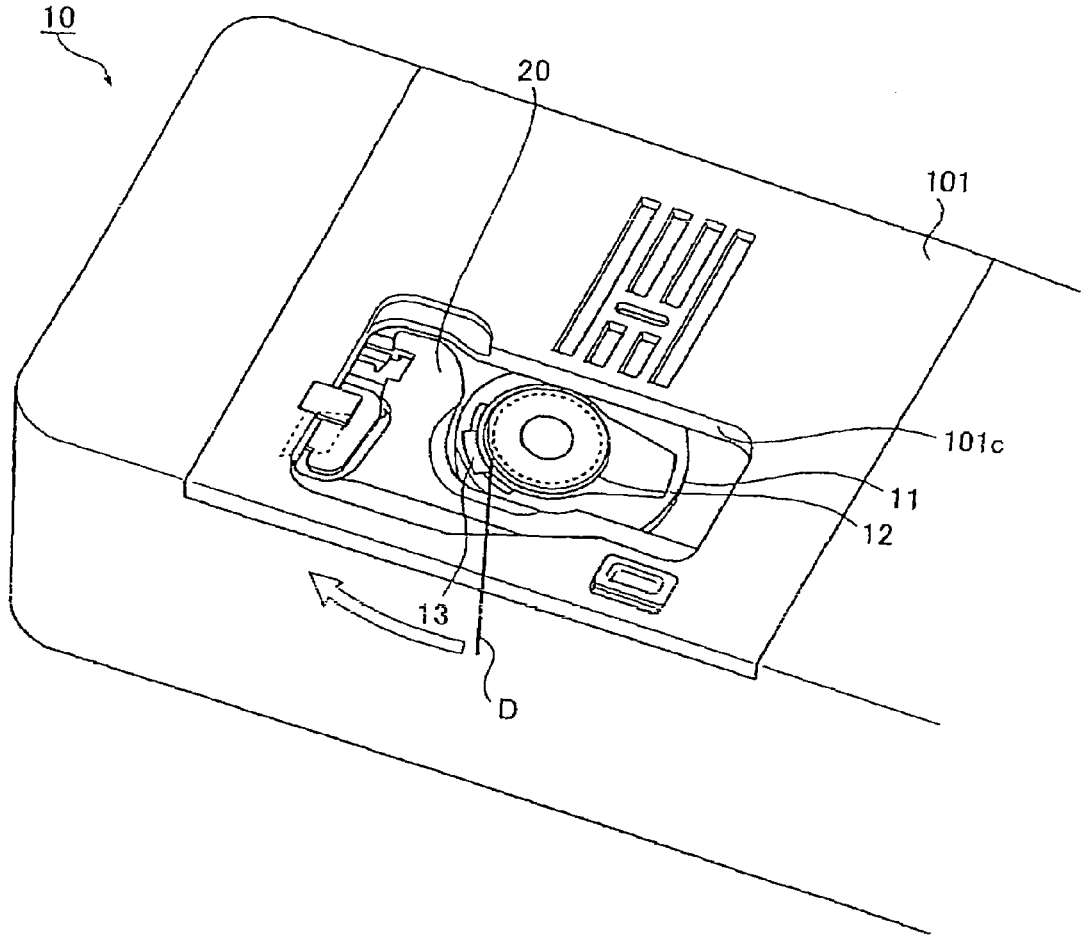
FIG. 7 is an explanatory view illustrating an operation of setting lower thread before a sewing operation and shows the state in which a lower thread bobbin is mounted.

FIG. 6 is a cross-sectional view cut along line Z—Z in FIG. 1. As shown in FIGS. 1, 2 and 6, the thread pressing portion 17 includes a hooked part 17*a* functioning as a thread pressing portion extended to a direction crossing to (substantially perpendicular to) a direction of hitching the lower thread D from the bending portion 16 to the lower thread cutting knife 14, a plate surface part 16*a* as a concave part provided in the upstream side of the direction of hitching the lower thread D from the bending portion 16 of the hooked part 17*a* to the lower thread cutting knife 14, and a concave part 17*b* provided at the bottom side of the thread pressing portion 17 in the downstream side of the direction of hitching the lower thread D from the bending portion 16 of the hooked part 17*a* to the lower thread cutting knife 14. In other words, the concave part at the upstream side is shared with the plate surface part 16*a* of the bending portion 16 in the lower thread supplying apparatus 10. However, it is possible to construct the concave part separately from the plate surface part 16*a* of the bending portion 16.

The direction of hitching the lower thread D from the bending portion 16 to the lower thread knife 14 is identical to the cloth feeding direction C. The plate surface part 16*a* and the concave part 17*b* are formed integrally with the cover plate 20 lower than other parts of the cover plate 20.

The hooked part 17*a* is formed integrally with the cover plate 20 and is shaped in a cantilever arm with the circumference cut. Besides, the hooked part 17*a* is formed with a folded part 17*c* at the end of its extended direction, and an upward slant surface 17*d* is formed at the bottom side of the end of the folded part 17*c*.

Due to the above-described structure, When the extracted end of the lower thread D is pulled from the bending portion 16 in a direction in reverse to the cloth feeding direction C and moved from the right side of the lower thread cutting knife 14 to its left side as shown in FIG. 2 for hitching the lower thread D from the bending portion 16 to the lower thread cutting knife 14, the lower thread D is fallen into the plate surface part 16*a* as a lowland and the inside of the concave part 17*b* and then guided under the hooked part 17*a* by the slant side 17*d*. Once the lower thread D is moved under the hooked part 17*a*, the lower thread D is prevented with a folded part 17*c* from diverting out of the hooked part 17*a*.

(Second Guide Portion)

The second guide portion 40 is arranged at the downstream side of the thread pressing portion 17 and integrated with the cover plate 20 in the lower thread passing route from the bending portion 16 to the lower thread cutting knife 14.

The second guide portion 40 is constructed with a groove part 41 formed by cutting the cover plate 20 along its curve and a plate-shaped part 42 forming the inner side of the groove part 41. Besides, the lower side of the plate-shaped part 42 is formed as the lower thread holding area through which the lower thread D passes.

Furthermore, the concave part 17*b* of the above-mentioned thread pressing portion 17 can also be constructed in a structure of guiding the lower thread D under the groove part 41 and the plate-shaped part 42.

Moreover, the lower thread cutting knife 14 is mounted at the one end of the groove part 41 while being fixed under the cover plate 20.

As shown in FIG. 3, a slant side 43 functioning as a sloped slant part is formed at the bottom surface of the plate-shaped part 42, rising to the end.

When the extracted end of the lower thread D is pulled from the bending portion 16 in the direction in reverse to the cloth feeding direction C and moved from the right side of the lower thread cutting knife 14 to its left side in FIG. 2 for hitching the lower thread D from the bending portion 16 to the lower thread cutting knife 14, the lower thread D is fallen into "a" as a lowland the concave part 17*b* and moved into the groove part 41 at the same time. Then, the lower thread D is guided to the lower side of the plate-shaped part 42 by the slant side 43. The extracted end of the lower thread D is moved in sliding contact with the edge and the lower surface of the plate-shaped part 42 along the groove part 41 and then cut when it reaches the lower thread cutting knife 14.

(Cover)

As described above, the opening part 101*c* is formed at the needle plate 101, and the step part 101*f* described above and the other one 101*g* are formed close to the opening part 101*c* at the top surface of the needle plate 101.

The cover 15 is integrated with the opening part 101*c*, the step parts 101*f* and 101*g*, and the lower surface of the cover 15 is mounted to the needle plate while being installed on the top surface of each of the step parts 101*f* and 101*g*. In addition, the thickness of the cover 15 is set up such that the top surface of the cover 15 is leveled with the top surface of the needle plate while the bottom side of the cover 15 faces the top surfaces of the step parts 101*f* and 101*g*.

(Lower Thread Passing Route)

The lower thread passing route is fanned as a line connecting from the lower thread bobbin 12 mounted at the internal hook ii through the tension applying portion 13, The first guide portion 30, the bending portion 16, the thread pressing portion 17, the second guide portion 40 and the Cower thread cutting knife 14.

At this time, the internal hook 11, the first guide portion 20, the bending portion 16, the thread pressing portion 17, the second guide portion 30 and the lower thread cutting knife 14 are arranged at the inner area of the opening part 101*c* seen from the top surface side of the needle plate 101. Therefore, it is not necessary to secure an accommodating portion for accommodating the lower thread cutting knife 14 and the lower thread D introduced to the lower thread cutting knife 14 by cutting the outside of the opening part 101*c* of the needle plate.

(Operational Processes of the Lower Thread Supplying Apparatus)

Operations of setting the lower thread before starting sewing will be described in accordance with FIGS. 7 through 11.

First of all, while the cover 15 is taken out of the opening part 101*c* of the needle plate 1C1, the lower thread bobbin 12 is accommodated in the internal hook 11. At this time, the lower Thread D is drawn to the near side (which corresponds to the upstream side of the cloth feeding direction C).

Figure 8:
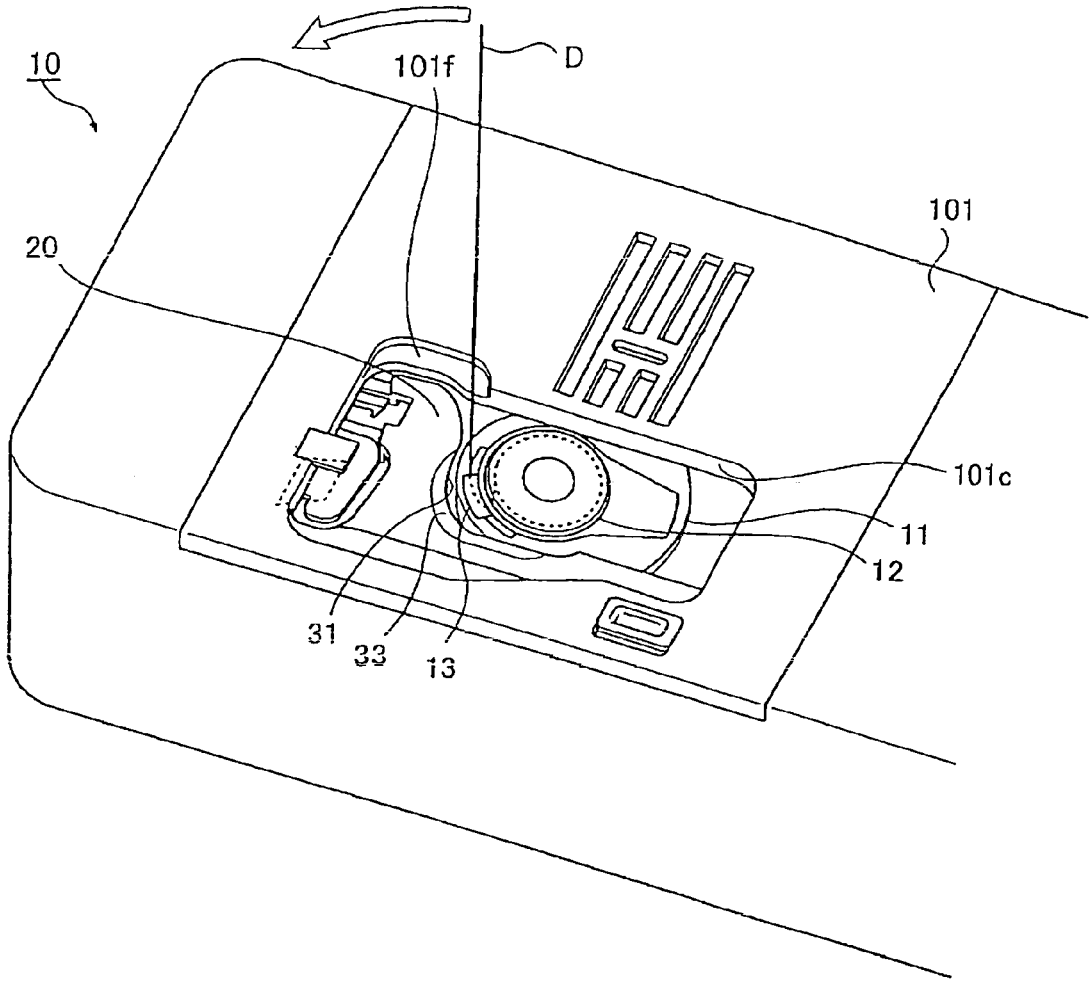
FIG. 8 is an explanatory view illustrating an operation of setting the lower thread before a sewing operation and shows the state in which the lower thread is arranged at a tension applying portion.
Figure 9:
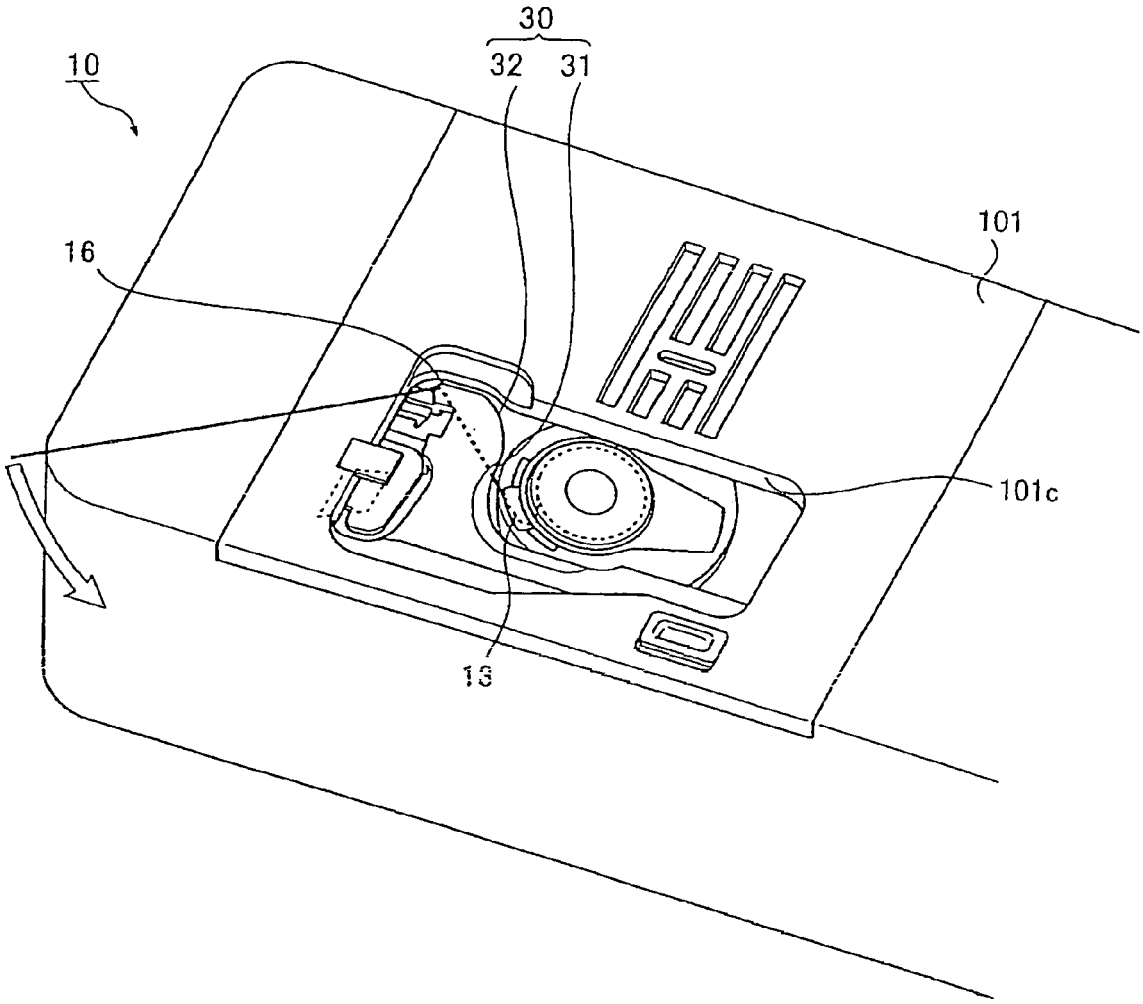
FIG. 9 is an explanatory view illustrating an operation of setting the lower thread before the sewing operation and shows the state in which the lower thread is arranged at a bending portion.
Figure 10:
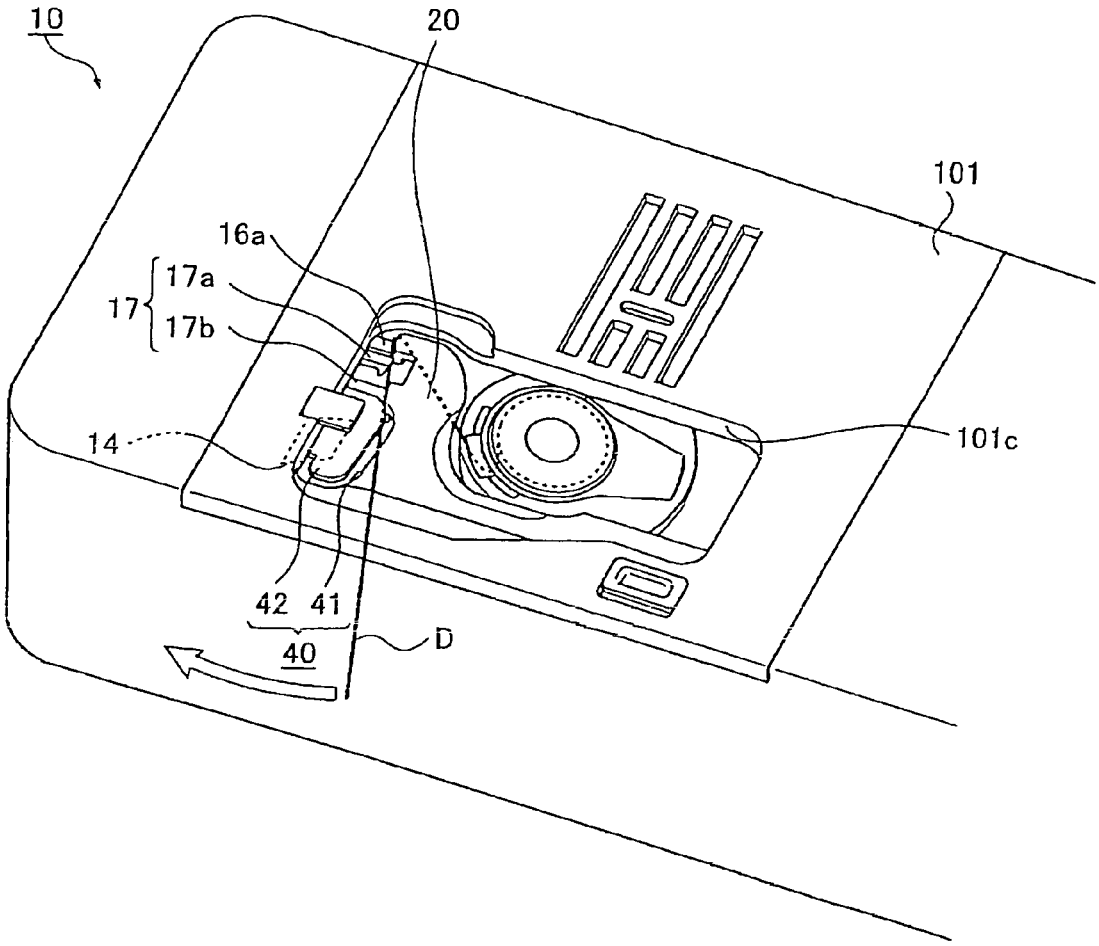
FIG. 10 is an explanatory view illustrating an operation of setting the lower thread before the sewing operation and shows the state just before the lower thread is guided to the lower thread cutting knife by a second guide portion.
Figure 11:
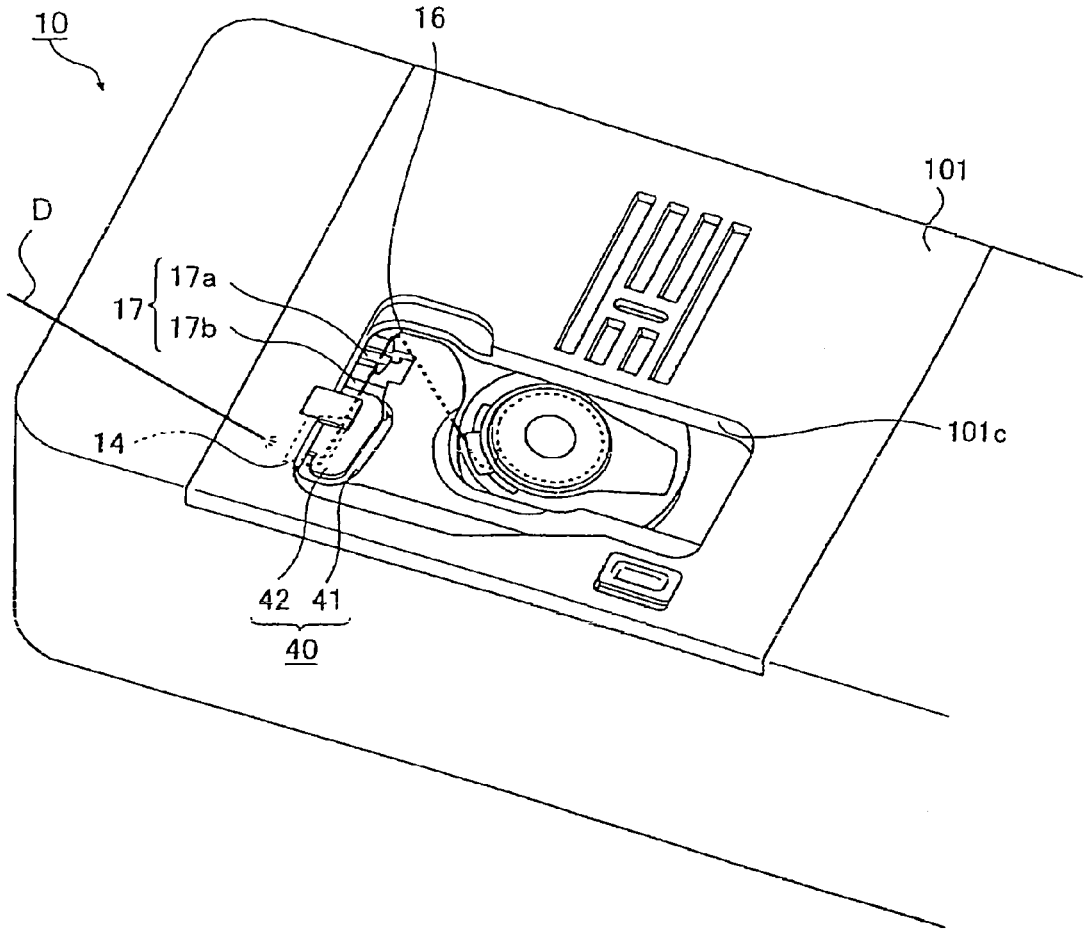
FIG. 11 is an explanatory view illustrating an operation of setting the lower thread before the sewing operation and shows the state after the lower thread is guided to the lower thread cutting knife by the second guide portion.

Furthermore, after the lower thread D is hitched to the plate member of the tension applying portion 13 by moving the extracted end of the lower thread D to the left side of FIG. 2, the extracted end of the lower thread D is moved to the back side (at the downstream side of the cloth feeding direction C) (see to FIG. 8).

At this time, since the first curve part 31 of the first guide portion 30 includes a downward sloped slant surface 33, the lower thread D drawn from the lower thread bobbin 12 can be laid down nearly horizontally with ease, thereby completing the process of hitching the lower thread D to the tension applying portion 13.

Next, when the extracted end of the lower thread D is moved to the left side of FIG. 2, the lower thread D is guided by the slant side 34 of the second curve part 32 of the first guide portion 30 to the lower thread holding area under the cover plate 20. Then, the extracted end of the lower thread D can be introduced to the bending portion 16 while being kept in the lower thread holding area (see FIG. 9).

At this time, the lower thread D drawn from the tension applying portion 13 can be laid down nearly horizontally because the step part 101*f* is arranged at the edge portion of the opening part 101*c* of the needle plate 101 against the edge portion of the second curve part 32 of the first guide portion 30, thereby making it possible to introduce the lower thread D to the lower thread holding area under the cover plate 20 from the second curve part 32 of the first guide portion 30 with ease.

Besides, when the extracted end of the lower thread D hitched at the bending portion 16 is pulled to the near side, the lower thread D is turned into its bent state. When the extracted end of the lower thread D is moved to the right side of FIG. 2, the lower thread D moves into the plate surface portion 16*a* of the bending portion 16 and the concave portion 17*b* of the thread pressing portion 17 and into the groove part 41 of the second guide portion 40 at the same time (see FIG. 10).

When the extracted end of the lower thread D is moved to the left side of FIG. 2, the lower thread D gets under the hooked part 17*a* by the slant side 17*d* formed at the end of the hooked part 17*a* of the thread pressing portion 17 to thereby prevent the lower thread D from diverting out of the hooked part 17*a* by the folded part 17*c* (refer to FIG. 6).

Besides, the lower thread D is introduced by the slant side 43 from the groove part 41 of the second guide portion 40 into the lower thread holding area under the plate-shaped part 42 (refer to FIG. 3), and the extracted end of the lower thread D slides along the groove part 41 to contact with the lower thread cutting knife. Then, the lower thread D is cut while a predetermined length is secured at the extracted end of the lower thread D.

(Effects of the Lower Thread Supplying Apparatus)

Effects of the lower thread supplying apparatus constructed in the above-mentioned structure will be described below.

Since the internal hook 11, the tension applying portion 13, the first guide portion 30, the bending portion 16, the thread pressing portion 17, the second guide portion 40 and the lower thread cutting knife 14 of the lower thread supplying apparatus 10 are all arranged at the inner area of the opening part 101*c*, the lower thread D can be accommodated under the cover 15. Accordingly, it is possible to effectively prohibit generation of any excessive tension, which occurs by the lower thread D being sandwiched between the cloth and the cover 15 or the top surface of the needle plate 101, at the beginning of the sewing operation. Therefore, a proper shape of seam is formed from the beginning of the sewing operation, thereby improving work quality of the sewing operation.

The lower thread supplying apparatus 10 is constructed with the bending portion 16 on the lower thread passing route for bending the lower thread passing route to secure a predetermined length of the lower thread needed for the sewing operation, thereby accommodating the lower thread passing route at the inner area of the opening part 101*c* without enlargement of its size. Therefore, groove or concave portion is not required at the top surface of the needle plate 101 for holding the lower thread D, and the opening part 101*c* can be made in a smaller size, thereby improving strength of the needle plate 101.

Besides, the removal of the groove or concave part interfering the smooth movement of the cloth results in improvement in the quality of the sewing operation by protection of the cloth with no damage.

The first and second guide portions 30, 40 respectively introducing the lower thread D from the tension applying portion 13 through the bending portion 16 and from the bending portion 16 through the lower thread cutting knife 14 are constructed to guide the lower thread D to the targeted positions in sliding contact, thereby making the job of hitching the lower thread D to the bending portion 16 or the lower thread cutting knife 14 with ease and rapidly to improve work efficiency.

Particularly, the guide portions 30 and 40 have respectively the slant sides 34 and 43 which guide the lower thread D to the lower area of the edge of the cover plate 20, thereby guiding the lower thread D more smoothly to improve work efficiency.

Besides, the respective guides 30 and 40 hold the lower thread D at the lower zones of the cover plates to protect the lower thread D from the outside more effectively and prevent generation of tension at the lower thread D, thereby improving the job quality of the sewing operation.

Furthermore, the lower thread D is held under the cover plates 20 to more effectively block the lower thread D from being missed out of the opening part 101*c* because the lower thread may freely sprung out when cut and to prevent generation of unexpected tension at the lower thread D, thereby improving job quality of the sewing operation.

Besides, since the lower thread supplying apparatus 10 is constructed with the thread pressing portion 17, even when the lower thread D rebounds due to tension at the time of the cutting step, the rebound motion is minimized by the folded part 17*c* of the hooked part 17*a* to effectively restrict accidents, such as the missing of the lower thread D out of the lower thread holding area of the second guide portion 40 and the bouncing of the lower thread D out of the opening part 101*c*. Therefore, it is possible to effectively restrict deterioration in work quality of the sewing operation due to excessive tension which is generated because the lower thread D is caught in the cover 15 or is trapped under cloth during the sewing operation.

While there has been described in connection with the preferred embodiments of the present invention, it will be obvious to those skilled in the art that various changes and modification may be made therein without departing from the present invention, and it is aimed, therefore, to cover in the appended claim all such changes and modifications as fall within the true spirit and scope of the present invention.

What is claimed is:

1. A lower thread supplying apparatus for a sewing machine, the lower thread supplying apparatus provided at an inner portion of a bed portion of the sewing machine, comprising:

a bobbin accommodating portion for detachably accommodating a lower thread bobbin from an opening part provided at a needle plate;

a tension applying portion for hitching a lower thread extracted from the lower thread bobbin so as to apply tension to the lower thread;

a lower thread cutting knife fixed at an end portion of a lower thread passing route to ensure a predetermined length of the lower thread which is applied from the lower tread bobbin to cut the lower thread;

a cover for covering the opening part, the cover being capable of opening and closing;

a cover plate fixed so as to be lower than the cover and higher than the tension applying portion for covering around the lower thread bobbin, the cover plate having an edge portion which is cut out in order to expose an upper portion of the lower thread bobbin;

a bending portion provided at a part of the edge portion of the cover plate for bending the lower thread from a lower side of the cover plate to an upper side of the cover plate;

a first guide portion for introducing the lower thread from the tension applying portion to the bending portion; and a second guide portion for introducing the lower thread from the bending portion to the lower thread cutting knife, wherein the bobbin accommodating portion, the tension applying portion, the bending portion and the lower thread cutting knife are provided at an inner area of the opening part.

2. The lower thread supplying apparatus according to claim 1, wherein the part of the edge portion of the cover plate is formed as the first guide portion for guiding the lower thread to the bending portion in sliding contact.

3. The lower thread supplying apparatus according to claim 2, wherein the first guide portion includes a slant part at the edge portion of the cover plate for sliding the lower tread under the cover plate.

4. The lower thread supplying apparatus according to claim 1, wherein the other part of the edge portion of the cover plate is formed as the second guide portion for introducing the lower thread to the lower thread cutting knife in sliding contact.

5. The lower thread supplying apparatus according to claim 4, wherein the second guide portion includes a slant part at the edge portion of the cover plate for sliding the lower thread under the cover plate.

6. The lower thread supplying apparatus according to claim 1, wherein a thread pressing portion is provided between the bending portion and the lower thread cutting knife for passing the lower thread thereunder.

7. The lower thread supplying apparatus according to claim 4, wherein a thread pressing portion is provided between the bending portion and the lower thread cutting knife for passing the lower thread thereunder.

8. The lower thread supplying apparatus according to claim 5, wherein a thread pressing portion is provided between the bending portion and the lower thread cutting knife for passing the lower thread thereunder.

9. A lower thread supplying apparatus for a sewing machine, the lower thread supplying apparatus provided at an inner portion of a bed portion of the sewing machine, comprising:

a bobbin accommodating portion for detachably accommodating a lower thread bobbin from an opening part provided at a needle plate;

a tension applying portion for hitching a lower thread extracted from the lower thread bobbin so as to apply tension to the lower thread;

a lower thread cutting knife fixed at an end portion of a lower thread passing route to ensure a predetermined length of the lower thread which is applied from the lower thread bobbin to cut the lower thread;

a cover for covering the opening part, the cover being capable of opening and closing;

a cover plate fixed so as to be lower than the cover and higher than the tension applying portion for covering around the lower thread bobbin, the cover plate having an edge portion which is cut out in order to expose an upper portion of the lower thread bobbin;

a bending portion provided at a part of the edge portion of the cover plate for bending the lower thread from a lower side of the cover plate to an upper side of the cover plate;

a first guide portion for introducing the lower thread from the tension applying portion to the bending portion; and a second guide portion for introducing the lower thread from the bending portion to the lower thread cutting knife, wherein the bobbin accommodating portion, the tension applying portion, the bending portion and the first and second guide portions are provided at an inner area of the opening part.

10. The lower thread supplying apparatus according to claim 9, wherein the part of the edge portion of the cover plate is formed as the first guide portion for guiding the lower thread to the bending portion in sliding contact.

11. The lower thread supplying apparatus according to claim 10, wherein the first guide portion includes a slant part at the edge portion of the cover plate for sliding the lower thread under a plate surface of the cover plate.

12. The lower thread supplying apparatus according to claim 9, wherein the other part of the edge portion of the cover plate is formed as the second guide portion for introducing the lower thread to the lower thread cutting knife in sliding contact.

13. The lower thread supplying apparatus according to claim 12, wherein the second guide portion includes a slant part at the edge portion of the cover plate for sliding the knife thread under a plate surface of the cover plate.

14. The lower thread supplying apparatus according to claim 9, wherein a thread pressing portion is provided between the bending portion and the lower tread cutting knife for passing the lower thread thereunder.

15. The lower thread supplying apparatus according to claim 12, wherein a thread pressing portion is provided between the bending portion and the lower thread cutting knife for passing the lower thread thereunder.

16. The lower thread supplying apparatus according to claim 13, wherein a thread pressing portion is provided between the bending portion and the lower thread cutting knife for passing the lower thread thereunder.

17. The lower thread supplying apparatus according to claim 6, wherein the bending portion, the thread pressing portion, and the first and second guide portions are integrally formed on the cover plate.

18. The lower thread supplying apparatus according to claim 14, wherein the bending portion, the thread pressing portion, and the first and second guide portions are integrally formed on the cover plate.

* * * * *